US006045395A

United States Patent [19]

Saito et al.

[11] Patent Number: 6,045,395

[45] Date of Patent: Apr. 4, 2000

[54] LOCK DETECTING CONNECTOR

[75] Inventors: Masashi Saito; Hajime Okada, both of Yokkaichi, Japan

[73] Assignee: Sumitomo Wiring Systems, Ltd., Japan

[21] Appl. No.: 09/015,694

[22] Filed: Jan. 29, 1998

[30] Foreign Application Priority Data

Feb. 5, 1997 [JP] Japan ..... 9-022866

[51] Int. Cl.[7] ..... H01R 3/00

[52] U.S. Cl. ..... 439/489; 439/354

[58] Field of Search ..... 439/350–357, 439/488, 489, 79

[56] References Cited

U.S. PATENT DOCUMENTS 5,562,486 10/1996 Saijo et al. ..... 439/489

5,613,872 3/1997 Fukuda et al. ..... 439/489

5,863,216 1/1999 Tsuji et al. ..... 439/489

FOREIGN PATENT DOCUMENTS 196 11 930 10/1996 Germany .

2285714 7/1995 United Kingdom .

*Primary Examiner*—Khiem Nguyen

*Attorney, Agent, or Firm*—Banner & Witcoff, Ltd.

[57] ABSTRACT

A contact face 16 of a rib 15 is arranged to be inclined downwards with respect to the fitting direction of connector housings 10,20. Detecting terminal fittings 14 make contact with the contact face 16 and are resiliently bent in a predetermined manner. If the rib 15 should be bent away from the detecting terminal fittings 14, the detecting terminal fittings 14 follow due to their inherent resilience and thereby maintain contact with the contact face 16.

10 Claims, 3 Drawing Sheets

LOCK DETECTING CONNECTOR

TECHNICAL FIELD

The present invention relates to a locking detecting connector that detects the locking of a pair of connector housings.

BACKGROUND TO THE INVENTION

FIG. 5 of this specification shows a conventional lock detecting connector comprising a male connector housing 1 and a female connector housing 5. The male connector housing 1 has a pair of long and thin detecting terminal fittings 3 protruding into a hood 2, and the detecting terminal fittings 3 are aligned horizontally with respect to one another. An overhanging rib 4 extends along the upper faces of the detecting terminal fittings 3. Further, the female connector housing 5 has a pair of short circuiting terminal fittings 6 comprising resilient contact members 6A.

When both the connector housings 1 and 5 are correctly fitted together, the resilient contact members 6A make contact with the pair of detecting terminal fittings 3. By short circuiting these detecting terminal fittings 3, the correct fitting position is detected. In the case where the female connector housing 5 is partially inserted into the hood 2, a locking arm 7 of the female connector housing 5 presses the resilient contact member 6A downwards, thereby releasing the short-circuit between the detecting terminal fittings 3. This results in the partially inserted state being detected.

In the detecting connector described above, the height of the detecting terminal fittings 3 is set by their position relative to the lower face of the rib 4. The lower face of the rib 4 is formed so as to be parallel to the insertion direction of the housings 1 and 5, the detecting terminal fittings 3 also being inserted into the housing 1 parallel to this direction and being located so as to rest along the lower face of the rib 4. Difficulties exist in achieving the correct alignment between the terminal fittings 3 and the lower face of the rib 4. If the detecting terminal fittings 3 change shape even slightly during, or prior to, their insertion into the housing 1, they may not rest along the lower face of the rib 4 and instead bend downward from the lower face of the rib 4. This results in the detecting terminal fittings being provided below their correct height. If the detecting terminal fittings 3 end up lower than their correct height, there exists the possibility of the lock detection feature no long operating correctly even if the difference in height is very small.

The present invention has been developed after taking the above problem into consideration, and aims to ensure that detecting terminal fittings are positioned with greater accuracy.

According to the invention there is provided a lock detecting connector comprising a pair of mutually fitting connector housings and a locking means for locking the two connector housings together, one of the connector housings have a male terminal fitting protruding towards the other connector housing and a support rib protruding along the male terminal fitting, the other connector housing having a female terminal fitting for electrical contact with the male terminal fitting, a locked state being detected, in use, if the female terminal fitting makes electrical contact with the terminal fitting, characterised in that a contact face of the support rib which makes contact with the male terminal fitting is inclined relative to the direction of fitting of the connector housings, the male terminal fitting making close contact in a resilient manner with the inclined contact face.

In use, when the male terminal fitting is inserted into the housing it is deflected along the inclined contact face of the rib. The resilient nature of the material from which the male fitting is manufactured ensures that it is sprung against the contact face. The male terminal fitting may take the form of a pair of detecting terminal fittings and the female terminal fitting may be a short circuit terminal fitting. In such an embodiment the locked state is detected if the short circuit terminal short circuits the detecting terminal fittings.

In a preferred embodiment a face of the rib opposite to that of the contact face is tapered with respect to the direction of fitting of the connector housings. A portion of the face opposite to the contact face at the root of the rib may also be parallel to the direction of fitting of the connector housings. The tapered rib enables the housing to be easily removed from a mould or former used in production of the connector housing.

The rib may preferably protrude from a rear face wall of the connector housing and into a hood of the connector housing the contact face of the rib may be inclined towards an inner surface of the hood. In a preferred embodiment the male terminal fitting is insertable into the connector housing in a direction parallel to the direction of fitting between the connector housings prior to being deflected by the contact face of the rib.

BRIEF DESCRIPTION OF DRAWINGS

Other features of the invention will be apparent from the following description of a preferred embodiment shown by way of example in the accompanying drawings in which.

DESCRIPTION OF A PREFERRED EMBODIMENT

Figure 1:
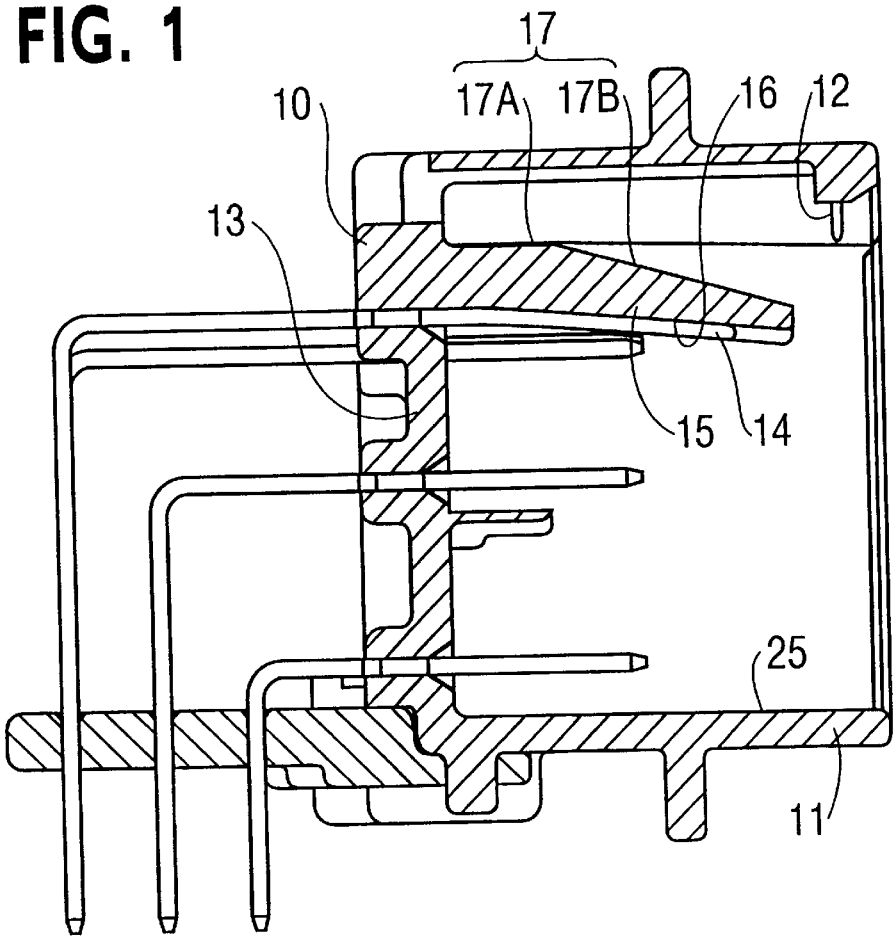
FIG. 1 is a cross-sectional view of a male connector housing.
Figure 2:
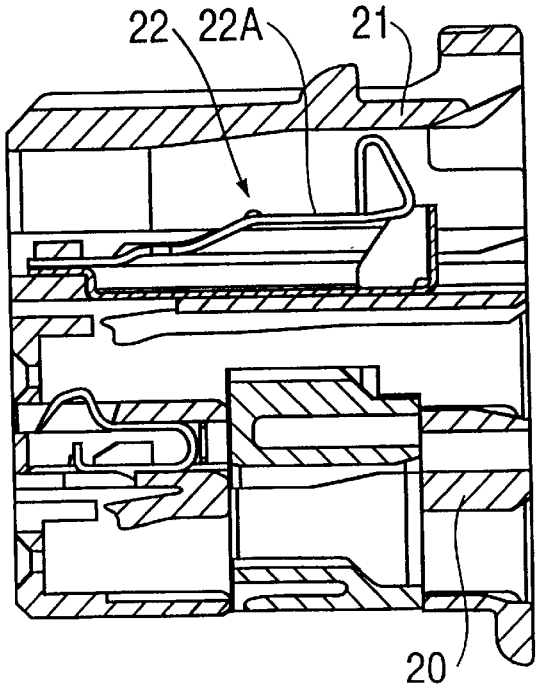
FIG. 2 is a cross-sectional view of a female connector housing.

An embodiment of the present invention is explained with reference to FIGS. 1 to 4.

A lock detecting connector of the present embodiment comprises a male connector housing 10 and a female connector housing 20 which fit together, a locking means for locking the connector housings 10 and 20 in a correct fitting position, and a detecting means for detecting whether or not locking has been effected by the locking means.

The locking means comprises a locking protrusion 12 formed on a hood member 11 of the male connector housing 10, and a locking arm 21 formed on the female connector housing 20. When the connector housings 10 and 20 are correctly fitted together, the locking arm 21 fits with the locking protrusion 12, thereby locking the connector housings 10 and 20 together. Further, when the housings 10,20 are partially fitted together, the locking arm 21 makes contact with a lower face of the locking protrusion 12 and is bent downward.

The detecting means comprises a pair of detecting terminal fittings 14 which extend through a rear face wall 13 of the male connector housing 10 and whose anterior ends both protrude inside the hood member 11 at the same height above a floor 25 of the male connector housing 10. The detecting terminal fittings 14 are additionally mutually aligned horizontally. The detecting means further comprises a pair of short-circuiting terminal fittings 22, located inside the female connector housing 20, which have resilient contact members 22A corresponding to the pair of detecting terminal fittings 14.

When the locking arm 21 fits with the locking protrusion 12 and the connector housings 10 and 20 are correctly fitted together, the pair of resilient contact members 22A make contact with the lower faces of the detecting terminal fittings 14 and short-circuit the detecting terminal fittings 14. The locking together of the housings 10,20 is detected by means of this short-circuiting operation.

Further, when the connector housings 10 and 20 are partially fitted together and the locking arm 21 is bent downwards, the locking arm 21 presses down the two resilient contact members 22A, thereby separating them from the detecting terminal fittings 14 and releasing the short-circuiting of the detecting terminal fittings 14. The unlocked state between the housings 10,20 is thus detected by means of this short-circuit releasing operation.

The male connector housing 10 has a rib 15 that protrudes from a rear face wall 13 and lies along the upper faces of the detecting terminal fittings 14. The rib 15 serves to fix the position of the detecting terminal fittings 14 at a specified height, and to prevent interference with the detecting terminal fittings 14 by foreign objects. The detecting terminal fittings 14 are thus maintained by the rib 15 at a specified height, and thereby allow the locking detection operation described above to be carried out accurately.

The lower face of the rib 15 constitutes a contact face 16 that abuts the detecting terminal fittings 14. The contact face 16 is inclined downwards towards the floor 25 of the male connector housing.

Figure 3:
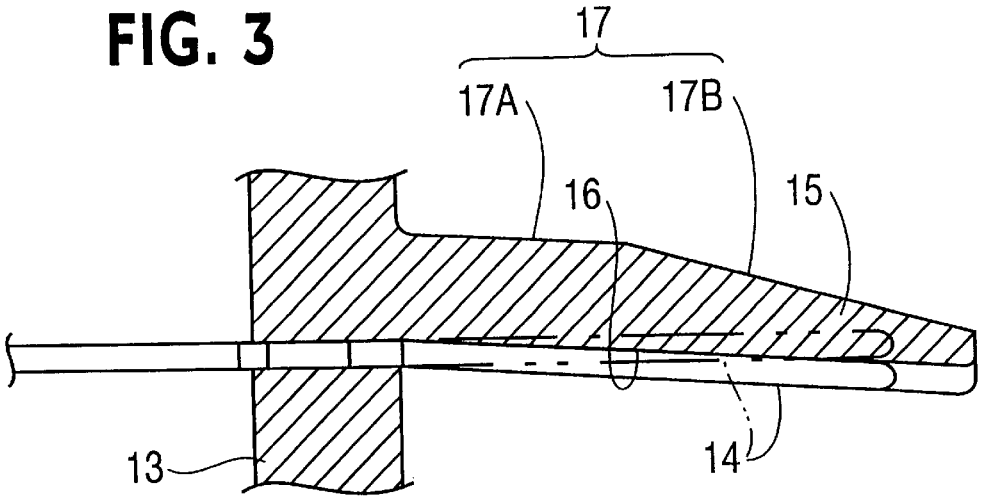
FIG. 3 is an enlarged cross-sectional view of a rib and detecting terminal fitting.

The detecting terminal fittings 14 are initially formed so as to protrude through the rear face wall 13 parallel to the direction of fitting between the housings 10,20 as shown in FIG. 3 by a broken line. However, when the detecting terminal fittings 14 have been passed through the posterior face wall 13 and have made contact with the contact face 16 of the rib 15, as shown by a solid line in FIG. 3, the detecting terminal fittings 14 are slightly inclined downwards. In this state, due to their resilient nature, the detecting terminal fittings 14 make close contact with the entirety of the contact face 16.

The operation of the present embodiment will now be explained. When the detecting terminal fittings 14 are in close contact with the rib 15, they are bent downwards in a resilient manner. Consequently, the position of the detecting terminal fittings 14 is maintained at the correct height and the detecting terminal fittings 14 remain in close contact with the rib 15. This arrangement compensates for cases where either the detecting terminal fittings 14 are initially slightly deformed, so as to be bent up or down, or the direction of insertion of the detecting terminal fittings 14 through the posterior face wall 13 is inclined downwards with respect to a correct direction (i.e. the direction of fitting between the connector housings 10 and 20). Thus close contact is maintained between the rib 15 and the detection terminal fittings 14 as long as the deformation of the detecting terminal fittings 14 or the misalignment of the insertion direction lie within the resilient bending range of the detecting terminal fitting 14. Consequently, the occurrence of a failure of the lock detecting operation resulting from a change in the height of the detecting terminal fittings 14 can be greatly reduced.

Figure 4:
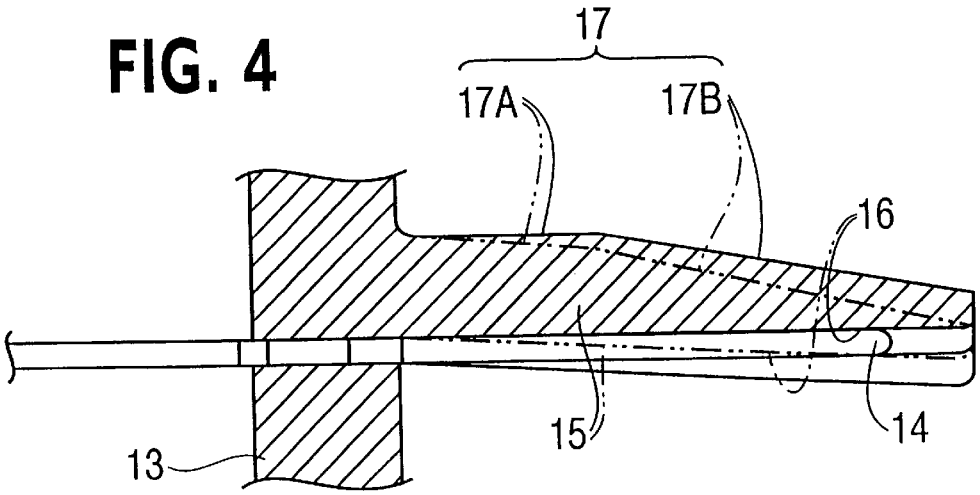
FIG. 4 is an enlarged cross-sectional view showing the rib bending in a direction away from the detecting terminal fitting.
Figure 5:
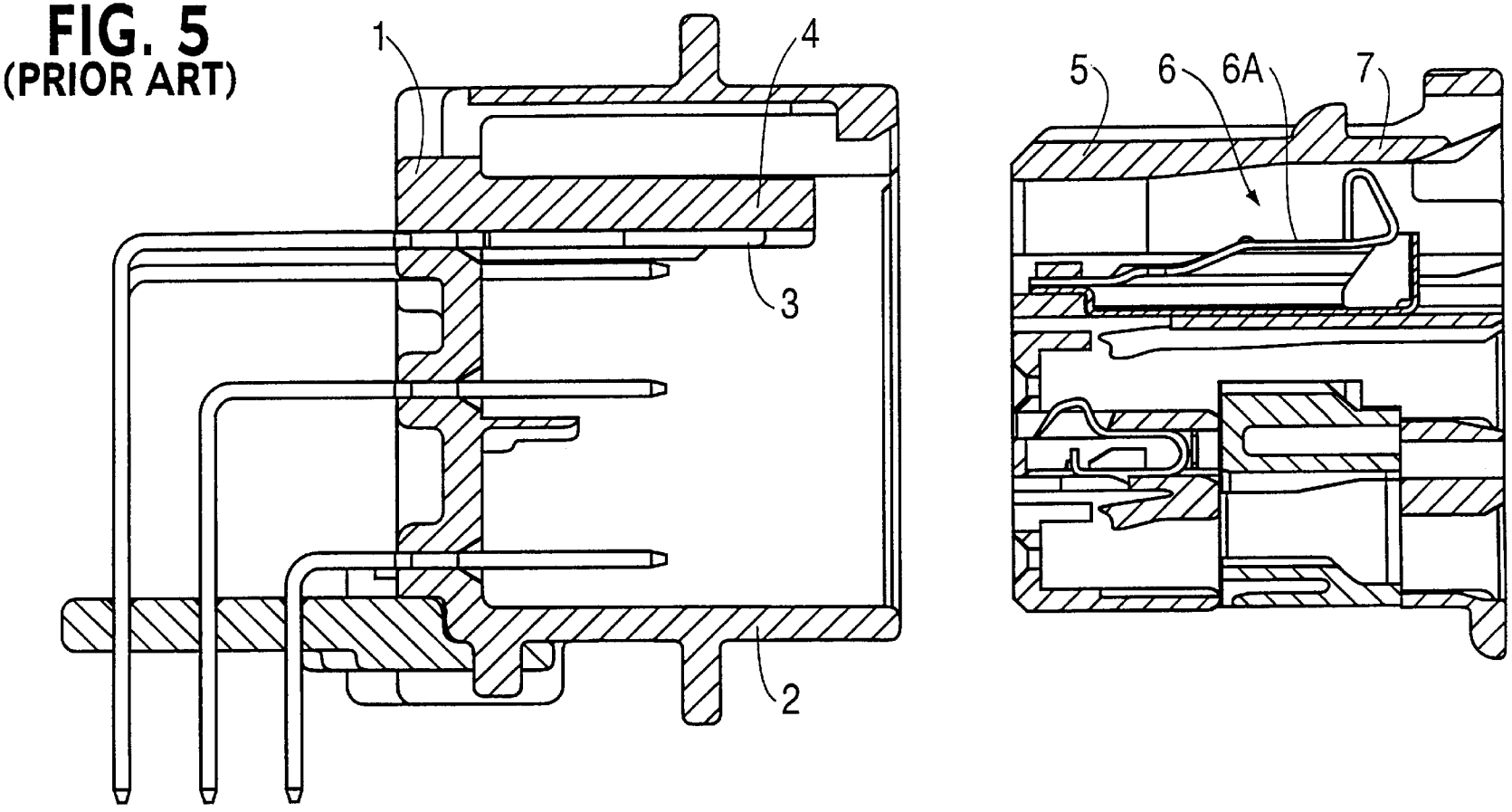
FIG. 5 (PRIOR ART)
FIG. 5 is a cross-sectional view of a conventional lock detecting connector.

When the female connector housing 20 is separated, the interior of the hood member 11 is open. As a result, it is possible that a foreign object can enter the hood member 11 and strike the rib 15 and bend the rib 15 upwards in the direction away from the detecting terminal fittings 14, This is shown in FIG. 4, with a broken line showing the state prior to bending and a solid line showing the bent state. However, even if the rib 15 is bent in this manner, the detecting terminal fittings 14 bend with the rib 15 due to their resilience, and, as shown in FIG. 4, maintain close contact with the entirety of the contact face 16. Consequently, the possibility of a foreign object making contact with the anterior ends of the detecting terminal fittings 14 and causing the detecting terminal fittings 14 to bend away from the rib is greatly reduced. Accordingly, the lock detecting function is not adversely affected if either the detecting terminal fittings 14 or the rib 15 is bent as described above.

Further, in the present embodiment, a base end portion 17A located on an upper face 17 of the rib 15 (the face opposite to the contact face 16) is formed parallel to the contact face 16, while an anterior portion 17B of the upper face 17 is tapered in the anterior direction. Consequently, removal of the rib 15 from a mould used to form the male connector housing 10 is made easier. Moreover, although the removal direction is parallel to the fitting direction of the connector housings 10,20, during removal from the mould the rib 15 is bent upwards slightly, thereby allowing the rib 15 to be removed from the mould without sustaining damage.

The present invention is not limited to the embodiment described above. For example, the possibilities described below also lie within the technical range of the present invention. In addition, the present invention may be embodied in various other ways without deviating from the scope thereof.

We claim:

1. A lock detecting connector comprising a pair of mutually fitting connector housings and a locking means for locking the two connector housings together, one of the connector housings having a first terminal fitting, a detecting terminal fitting, and a support rib each protruding toward the other connector housing, said support rib having a contact face in contact with the detecting terminal fitting, the other connector housing having a second terminal fitting for electrical contact with the first terminal fitting and a contact member, wherein said contact member and said detecting terminal fitting make an electrical connection only when the two connector housings are in a locked state to thereby detect the fully fitted condition of the first and second terminal fittings, and wherein the contact face of the support rib is inclined relative to the direction of fitting of the connector housings so as to extend outward and toward the detecting terminal fitting so that the detecting terminal fitting is bent to lie in close contact in a resilient manner with the inclined contact face.

2. A lock detecting connector according to claim 1 which further comprises a second detector terminal fitting and wherein the contact member comprises a short circuit terminal fitting, the locked state being detected, in use, when the short circuit terminal fitting short circuits the pair of detecting terminal fittings.

3. A lock detecting connector according to claim 1 wherein a first portion of a face of the support rib opposite to that of the contact face is tapered with respect to the direction of fitting of the connector housings.

4. A lock detecting connector according to claim 3 wherein a second portion of the face of the support rib opposite to the contact face is also parallel to the direction of fitting of the connector housings.

5. A lock detecting connector according to claim 1 wherein the support rib protrudes from a rear face wall of the connector housing and into a hood of the connector housing.

6. A lock detecting connector according to claim 5 wherein the contact face is inclined towards an inner surface of the hood.

7. A lock detecting connector according to claim 5 wherein the first terminal fitting and the detecting terminal fitting are insertable into the connector housing through the rear face wall.

8. A lock detecting connector according to claim 6 wherein the first terminal fitting and the detecting terminal fitting are insertable into the connector housing through the rear face wall.

9. A lock detecting connector according to claim 7 wherein the first terminal fitting and the detecting terminal fitting are insertable in a direction parallel to the direction of fitting between the connector housings.

10. A lock detecting connector according to claim 8 wherein the first terminal fitting and the detecting terminal fitting are insertable in a direction parallel to the direction of fitting between the connector housings.

* * * * *